US006652191B2

(12) United States Patent
Moga

(10) Patent No.: US 6,652,191 B2
(45) Date of Patent: Nov. 25, 2003

(54) SELF-ADJUSTING WATER PRESSURE RESPONSIVE DIVER'S WEIGHT BELT ASSEMBLY

(76) Inventor: Thomas Traian Moga, 9711 Days Farm Dr., Vienna, VA (US) 22182

( * ) Notice: Subject to any disclaimer, the term of this patent is extended or adjusted under 35 U.S.C. 154(b) by 0 days.

(21) Appl. No.: 10/062,712

(22) Filed: Feb. 5, 2002

(65) Prior Publication Data

US 2003/0147701 A1 Aug. 7, 2003

(51) Int. Cl.[7] ..... B63C 11/02

(52) U.S. Cl. ..... 405/186; 403/31; 403/32; 403/294; 403/377

(58) Field of Search ..... 405/185–187; 403/1, 31, 32, 292–294, 375, 377; 277/435–437

(56) References Cited

U.S. PATENT DOCUMENTS 2,992,479 A * 7/1961 Musser et al. ..... 403/31
4,789,270 A * 12/1988 Selisky ..... 405/186
4,808,033 A * 2/1989 Belmonte ..... 405/186
5,102,253 A * 4/1992 Pugliesi-Conti et al. ..... 403/31

* cited by examiner

*Primary Examiner*—Thomas B. Will
*Assistant Examiner*—Tara L. Mayo

(57) ABSTRACT

A self-adjusting, water pressure-responsive weight belt assembly for use in diving is disclosed. The assembly includes a tensioning portion comprising a housing and a reciprocating member reciprocatingly disposed within the housing. The housing comprises a cover and a hollow base to which one end of a flexible belt portion is attached. An end of the reciprocating member is situated external of the housing by being disposed in a position partially outside of the reciprocating member housing cover through a slot defined therein. The other end of the flexible belt portion is attached to one end of the reciprocating member. An air space of variable volume exists within the housing and is defined by the inner walls of the reciprocating member housing base and an end wall of the reciprocating member. The reciprocating member moves within the housing, thereby adjusting the fit of the assembly on the diver in response to changes in water pressure.

20 Claims, 2 Drawing Sheets

SELF-ADJUSTING WATER PRESSURE RESPONSIVE DIVER'S WEIGHT BELT ASSEMBLY

FIELD OF THE INVENTION

The present invention relates to a diver's weight belt. More particularly, the present invention relates to a self-adjusting, water pressure-responsive weight belt assembly for use in free diving.

DESCRIPTION OF THE RELEVANT ART

Early sponge divers did not use diving equipment, yet were nevertheless successful in harvesting these primitive marine animals. Of course, sponge diving is still practiced today, and little of the sponge diver's equipment has changed over time. What the sponge diver's modicum of equipment gains him in simplicity and convenience is lost in his inability to remain submerged for long periods.

Divers equipped to stay submerged for long periods of time generally fall into two groups—tethered "helmet" divers who rely on remote surface assistance, and free divers who move about free of assistance or support.

Tethered divers most commonly include those with direct links to the surface in the form of safety and air lines, or the "helmet" divers. These divers use heavy gear including weighted boots, a pliable suit, and a rigid helmet. This considerable mass is not simply the result of a designer's quest for durability, but is largely the result of the need to overcome the tendency of humans to float.

Because humans are land dwellers, we have adapted to and are thus able to withstand pressure exerted upon us by air (14 psi or one atmosphere). Once we enter the water, however, the physics of our local environment change significantly, and, for unequipped land dwellers, this environment is hostile. Air has a mass density of 1.29 $kg/m^3$ compared with a mass density of $1.0\times10^3$ $kg/m^3$ at 4° C. for water. The diver is subjected to much greater pressure than is, for example, a person strolling upon an adjacent beach. In addition, water pressure is proportional to depth. The deeper the dive, the greater pressure—so great that a pressure of two atmospheres is exerted upon the diver at 10 meters. For every additional 10 meters of depth, the pressure exerted upon the diver increases by one atmosphere.

The laws of physics present humans wanting to dive with a physiological problem. The human body comprises in large part relatively incompressible materials, such as bone (having Young's Modulus [compression] value of $9.4\times10^9$) and liquids. But the human body is also provided with a series of cavities that normally contain a volume of gases. These cavities include the lungs, the sinuses, the stomach and the inner ear. Each of these cavities is connected with the respiratory system. These cavities not only add to the buoyancy of the diver, but also require that the pressure of the respiratory system be such that these cavities are not allowed to collapse.

Accordingly, the rigid helmeted suit is pressurized from the surface to maintain respiratory pressure, and is also weighted to compensate for the pressurized air. The considerable weight of this diver's suit is necessary—such as would be necessary to sink an inflated balloon.

Free divers, those divers who carry their own supply of air in a pressurized cylinder, also have buoyancy problems that must be overcome by weights. In addition to the positive buoyancy created by the diver's many air-filled body cavities, the diver's conventional protection against cold water—the semi-porous wet suit—adds to the overall positive buoyancy.

Beyond their air cylinders, free divers also wear a vest-like device called the "buoyancy compensator" or the "b.c." that is fluidly connected with the diver's air supply. The diver can selectively inflate or deflate the b.c. at will as necessary to compensate for pressure changes in the water according to the depth that would otherwise cause the diver to float or sink. To compensate for the air carried in the tank by the diver, the diver's gas-filled cavities, and the wetsuit, a weight belt is worn, and includes a belt and one or more weights slipped onto the belt through a slotted aperture defined through the weight. The diver traditionally experiments with different amounts of weight that are neither inadequate nor excessive in order to achieve a force to counterbalance his buoyancy.

To insulate himself from the cold of the surrounding water, and as briefly mentioned above, the typical diver utilizes a wet suit comprising a lower part and an upper jacket part (the familiar "farmer John" or "farmer Jane" suit). A sleeveless and legless "shorty" suit is used in warmer waters. The typical wet suit of the diver comprises compressible, semi-porous, expanded neoprene material. And this is where a big part of the diver's buoyancy problem arises.

The wet suit must be elastic to accommodate the shape of the diver's body. Neoprene is the material of choice, in that it allows water to flow in and out to "breathe". Neoprene, as noted, is also compressible, and as water pressure increases, so the thickness of the wet suit is reduced by compression. This characteristic in itself is not a problem, but it is a problem with respect to the weight belt, which does not compress. At depth, the diver's weight belt, which fits snugly on the surface, does not fit properly due to the reduction of the outer dimension of the wet suit, and tends to work its way toward the diver's legs. With all of the diver's other underwater concerns, a maladjusted weight belt is an unacceptable inconvenience. This problem becomes more acute during an ascent where gravity exerts a force upon the belt that is exaggerated by the upward motion of the diver.

Weight belt accessories have been designed in the past in an effort at overcoming this problem. For example, U.S. Pat. No. 3,470,570 issued in 1969 to Christiansen discloses an expansible diver's weight belt that comprises "[a]n elastic element [having] ends secured to spaced portions of the belt and threads through an accordion-folded portion of the belt." While improving the situation somewhat, many divers have found that this construction fails to provide relief because the mass of the weights easily overcome the resistance provided by the elastic elements of Christiansen's belt accessory. Simply, the problem still exists.

Accordingly, prior approaches to solving the problem of providing a weight belt that truly responds to changes in water pressures brought about by the diver's passing through waters of different depths have failed.

SUMMARY OF THE PRESENT INVENTION

It is therefore the general object of the present invention to provide a self-adjusting, water pressure-responsive weight belt assembly that overcomes the problems of known weight belts.

A specific object of the present invention is to provide such a belt assembly that responds immediately and directly to changes in water pressure.

An additional object of the present invention is to provide such a belt with a flexible belt portion and a tensioning portion.

A further object of the present invention is to provide such a belt assembly that includes a housing and a reciprocating member, at least a portion of which is reciprocatingly disposed within the housing.

Yet another object of the present invention is to provide such a belt assembly in which a quantity of gas is captured between the interior walls of the housing and the reciprocating member.

Still a further object of the present invention is to provide such a belt assembly in which the reciprocating member may be an interchangeable weight and may thus be interchanged with weights of different values.

An additional object of the present invention is to provide such a belt assembly in which the utilization of a reciprocating member in the form of an interchangeable weight eliminates the need for additional conventional weights to be fitted to the weight belt.

It is a further object of the present invention to provide such a belt assembly having a housing that is composed of a durable yet readily formed polymerized material.

Another object of the present invention is to provide such a belt assembly that is resistant to both salt water and fresh water.

Yet a further object of the present invention is to provide such a belt assembly that is relatively simple to maintain and to operate.

These and other objects are accomplished by the provision of a self-adjusting, water pressure-responsive weight belt assembly for use in free diving in which the tension of the belt is self-adjusting according to changes in ambient water pressure. The weight belt according to the present invention includes a flexible belt portion and a tensioning portion. The tensioning portion effects changes in the overall length of the weight belt assembly in direct response to changes in water pressure. The flexible belt portion includes a conventional weight belt buckle for attachment and release. The tensioning portion is fitted to the flexible belt portion.

The tensioning portion comprises a housing and a reciprocating member that is substantially reciprocatingly disposed within the housing. The housing comprises a substantially hollow base and a housing cover. A first end of the flexible belt portion is attached to the substantially hollow base. The housing cover is releasably attached to the housing base and includes a reciprocating member slot defined therein. The reciprocating member is reciprocatingly movable substantially within the hollow base of the housing. The reciprocating member may be a hollow member or may be a solid weight. An end of the reciprocating member is situated external of the housing by being disposed in a position partially outside of the reciprocating member housing cover through the slot defined therein. The other end of the flexible belt portion is attached to one end of the reciprocating member. One or more O-rings are provided on the portion of the reciprocating member which is disposed within the housing. An air space of variable volume exists within the interior of the water pressure responsive assembly and is defined by the inner walls of the reciprocating member housing base and an end wall of the reciprocating member. The O-rings form a fluid-tight seal which resists entry of water into the air space of the pressure responsive assembly.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENTS

The drawings disclose the preferred embodiments of the present invention. While the configurations according to the illustrated embodiment are preferred, it is envisioned that alternate configurations of the present invention may be adopted without deviating from the invention as portrayed. The preferred embodiments are discussed hereafter.

Figure 1:
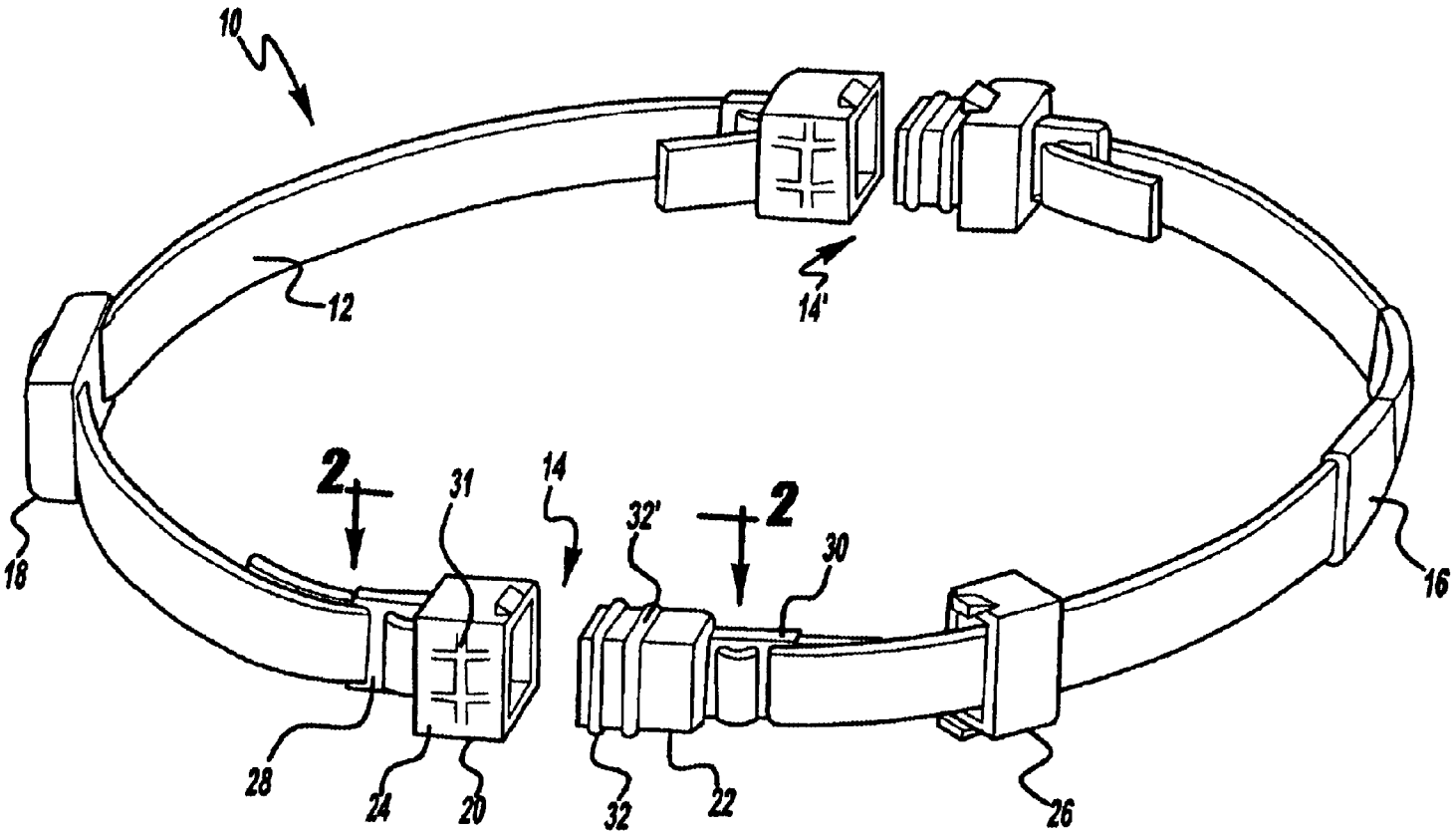
FIG. 1 is a perspective view of a self-adjusting, water pressure-responsive weight belt assembly according to the present invention illustrating the flexible belt portion and tensioning portion.

With respect to FIG. 1, a perspective view of a self-adjusting, water pressure-responsive weight belt assembly according to the present invention, generally illustrated as 10, is shown. The weight belt assembly 10 includes a flexible belt portion 12 and a pair of opposed tensioning portions 14, 14'. (While two tensioning portions 14, 14' are illustrated, it is to be understood that as few as one tensioning portion may be used, while more than the illustrated two may be used. As described herein, the tensioning portions 14, 14' are substantially identical, so only one—tensioning portion 14—will be described herein.)

The flexible belt portion 12 is preferably composed of a nylon mesh material as is conventionally used in weight belt construction. Also, as is known in conventional weight belts, a stainless steel weight belt buckle assembly 16 is provided for easy engagement and disengagement of the buckle from the diver's waist. In addition, a diver's weight 18 is shown fitted to the flexible belt portion 12. The weight 18 may be interchangeable with other weights as is known in the art. However, the use of additional weights 18 may be rendered unnecessary by the present invention in the event that part of the tensioning portion is weighted, as will be discussed below according to one embodiment of the invention.

The tensioning portion 14 comprises a housing 20 and a reciprocating member 22 that is substantially reciprocatingly disposed within the housing 20. The housing 20 comprises a substantially hollow base 24 and a housing cover 26 that is releasably attached to the hollow base 24. The hollow base 24 includes a belt clip 28 extending therefrom to which an end of the flexible belt portion 12 is removably attached. Similarly, the reciprocating member 22 includes a belt clip 30 extending therefrom to which the other end of the flexible belt portion 12 is removably attached. Both the hollow base 24 and the housing cover 26 are preferably composed of a polymerized material to provide strength and corrosion resistance. A series of ribs 31 may be provided on one or both of the hollow base 24 (as illustrated) and the housing cover 26 (not shown) to provide re-enforcement as may be needed to provide the proper integrity for these elements.

The reciprocating member 22 may be a solid member or a hollow member. It may be composed of a polymerized material (such as a polystyerene or rubber) or it may be composed of a metal. The reciprocating member 22 may be a weighted member and may substitute for or may supplement the weight 18. The reciprocating member 22 may be interchanged with other heavier or lighter reciprocating members 22 depending on the needs of the diver.

Regardless of its composition, the reciprocating member 22 has fitted to it sealing O-rings 32, 32' in a pair of spaced apart grooves 33, 33'. (While two O-rings are illustrated, it is to be understood that this number may be increased or decreased as preferred.) The sealing O-rings 32, 32' provide a fluid-tight seal between the outer dimension of the reciprocating member 22 and the inner wall of the housing 20.

Figure 2A:
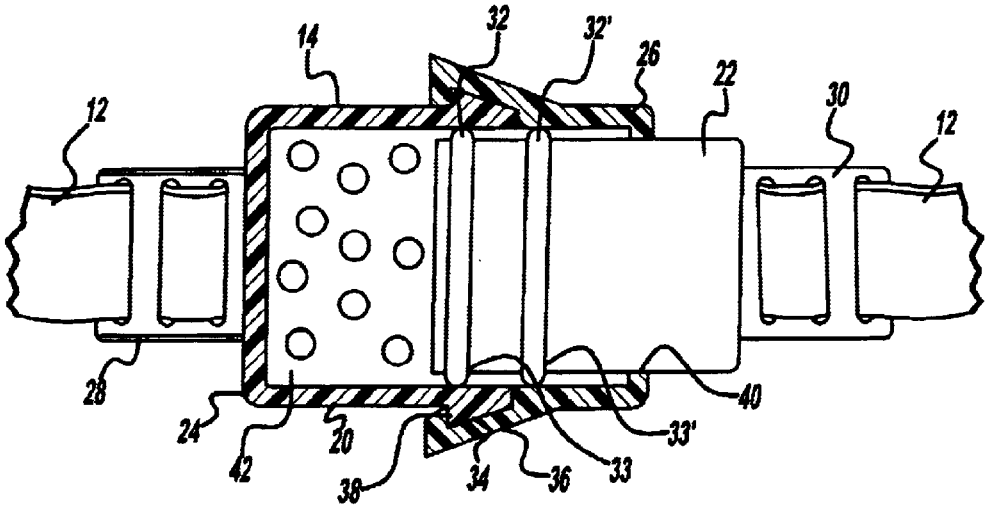
FIG. 2A is a sectional view of a tensioning portion of the self-adjusting, water pressure-responsive weight belt assembly according to the present invention in which the volume of gas captured between the inner wall of the reciprocating member and the interior walls of the housing is uncompressed, and, hence, the tensioning portion is elongated.

Referring to FIG. 2A, a sectional view of the tensioning portion 14 of the present invention in its uncompressed, expanded state is illustrated. The housing cover 26 is releasably attached to the housing base 24 by a clip assembly 34. The clip assembly 34 includes a resilient, semi-flexible clip 36 and a clip base 38. The clip 36 is releasably engaged to the clip base 38 as illustrated. In the event that the reciprocating member 22 is an interchangeable weight, the housing cover 26 may be readily removed from the housing base 24 by operation of the clip assembly 34.

As illustrated in FIG. 2A, a portion of the reciprocating member 22 extends out of the housing 20 through a slot 40 defined in the housing base. As illustrated, the slot 40 has a close tolerance with respect to the outer configuration of the reciprocating member 22. Because it cannot pass through the slot 40, the O-ring 32' prevents the reciprocating member 22 from being inadvertently removed from the housing 20.

As may be seen, a variably sized air space 42 exists within the interior of the housing 20 and is defined partially by the inner wall of the reciprocating member 22.

Figure 2B:
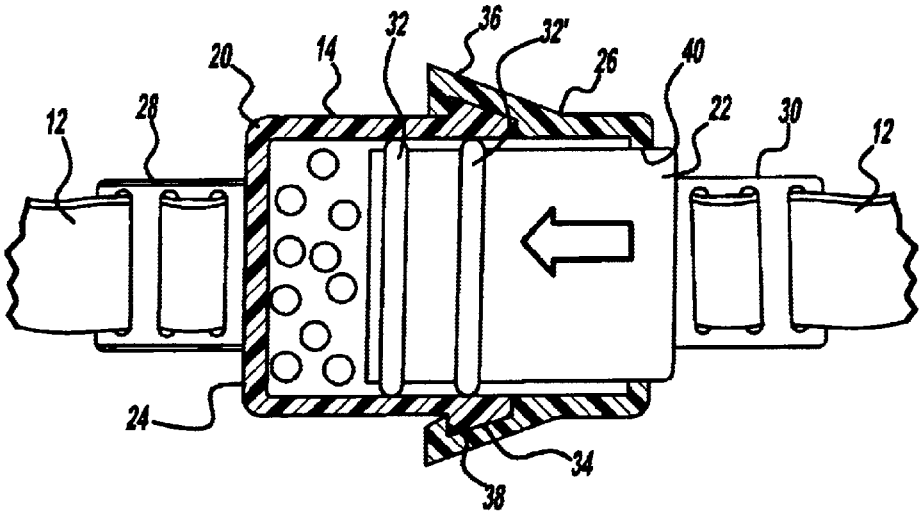
FIG. 2B is a sectional view of the tensioning portion shown in FIG. 2A but illustrating the captured gas as being compressed and, hence, the tensioning portion is shortened.

FIG. 2B is a sectional view of a self-adjusting accessory for a weight belt according to the present invention in which the accessory is substantially identical to that as shown in FIG. 2A but the captured gas within the air space 42 is now illustrated as being in its compressed stage. This is how the tensioning portion 14 would appear under pressure. As is shown, the reciprocating member 22 has been moved inward toward the hollow base 24 in response to changes in pressure, thus reducing the overall diameter of the combination of the belt portion 12 and the tensioning portion 14. In such manner the self-adjusting, water pressure-responsive weight belt assembly 10 of the present invention compensates for changes in water pressure and overcomes the restrictions of known compensator devices.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An accessory for adjusting the length of a diver's weight belt in response to changes in water pressure, the weight belt having a first end and a second end, the accessory comprising, in combination:

a housing portion having a first end, a second end and a second end region, said second end being adjacent said second end region, said first end being attachable to the first end of the belt, said housing portion having a substantially hollow interior, and said second end of said housing portion being open;

a reciprocating member having a first end, a second end, and a second end region, said second end being attachable to the second end of the belt, said member being reciprocatingly fittable within said housing portion; and a cover portion having a substantially centrally defined aperture, said cover portion being fittable to said second end region, said second end region of said reciprocating member being substantially reciprocatingly slidable through said aperture in said cover portion;

whereby a gas pocket is formed within said interior of said housing portion when said reciprocating member is fitted within said housing portion, said gas being compressible by said reciprocating member in response to said changes in water pressure.

2. The adjusting accessory according to claim 1 wherein said reciprocating member is substantially hollow.

3. The adjusting accessory according to claim 1 wherein said reciprocating member is substantially solid.

4. The adjusting accessory according to claim 3 wherein said solid reciprocating member comprises an interchangeable weight.

5. The adjusting accessory according to claim 4 wherein said interchangeable weight is interchangeable with weights of different weight amounts.

6. The adjusting accessory according to claim 5 wherein said weights are coated with a resilient polymerized material.

7. The adjusting accessory according to claim 1 wherein said housing portion includes a plurality of sides, at least one of said plurality of sides having reinforcing ribs provided thereupon.

8. The adjusting accessory according to claim 1 wherein said first end of said housing portion and said second end of said reciprocating member are fitted with weight belt attachment loops.

9. The adjusting accessory according to claim 1 wherein said reciprocating member includes a body portion, said body portion being fitted with at least one water-tight sealing ring peripherally mounted thereabout.

10. The adjusting accessory according to claim 1 wherein said cover portion is removably fittable.

11. The adjusting accessory according to claim 10 including means for removably attaching said cover portion to said housing portion.

12. The adjusting accessory according to claim 11 wherein said means for removably attaching said cover portion to said housing portion comprises at least one set of interlockable male and female tabs.

13. The adjusting accessory according to claim 1 wherein said centrally defined aperture of said cover portion is defined by a peripheral lip, said lip having an inside and an outside.

14. The adjusting accessory according to claim 13 wherein said reciprocating member includes means for abutting said reciprocating member against said inside of said peripheral lip thereby holding said reciprocating member substantially within said housing portion, said means for abutting comprising a ring peripherally defined about said reciprocating member.

15. An accessory for adjusting the length of a diver's weight belt in response to changes in water pressure, the accessory being fitted to a weight belt, the weight belt having a first end and a second end, the accessory comprising, in combination:

a housing portion attachable to the first end of the belt, said housing portion having defined therein a substantially hollow interior;

at least one reciprocating member attachable to the second end of the belt, said member having an end portion, said member being reciprocatingly fittable within said housing portion;

whereby a gas pocket is formed within said interior of said housing portion when said reciprocating member is fitted within said housing portion, said gas being compressible by said reciprocating member in response to said changes in water pressure.

16. The adjusting accessory according to claim 15 further including a portion for holding said reciprocating member substantially within said housing portion.

17. The adjusting accessory according to claim 16 wherein said portion comprises a cover having an aperture defined therein for permitting reciprocating passage of said end portion of said reciprocating member.

18. The adjusting accessory according to claim 15 wherein said reciprocating member is substantially hollow.

19. The adjusting accessory according to claim 15 wherein said reciprocating member is a substantially solid, interchangeable weight.

20. A weight belt adjusting accessory responsive to changes in water pressure for use in association with a diver's weight belt, the accessory comprising, in combination:

a housing portion having an inside and an outside;

a reciprocating member reciprocatingly fittable within said housing portion;

whereby a gas is trapped between said reciprocating member and said inside of said housing portion, said reciprocating member being movable within said housing portion in response to said changes in water pressure external to said accessory.

* * * * *